United States Patent [19]

Jackson

[11] 3,977,278

[45] Aug. 31, 1976

[54] AUTOMOTIVE ELECTRIC IMPACT WRENCH

[75] Inventor: John Van Jackson, Oak Lawn, Ill.

[73] Assignee: Lawrence Peska Associates, Inc., New York, N.Y. ; a part interest

[22] Filed: June 18, 1975

[21] Appl. No.: 588,037

[52] U.S. Cl. ..... 81/57.11

[51] Int. Cl.[2] ..... B25B 17/00

[58] Field of Search..... 81/57.11, 57.12, 57.13, 81/57.14; 240/6.46; 30/DIG. 1

[56] References Cited

UNITED STATES PATENTS

| | | | |
|---|---|---|---|
| 1,298,504 | 3/1919 | Hollingshead | 81/57.14 |
| 1,603,986 | 10/1926 | Rosenberg | 240/6.46 |
| 1,639,889 | 8/1927 | Humm | 240/6.46 |
| 1,970,179 | 8/1934 | Miller | 81/57.14 |
| 2,134,081 | 10/1938 | Gaede | 240/6.46 |
| 2,341,375 | 2/1944 | Hambleton | 240/6.46 |
| 2,673,284 | 3/1954 | Henderson | 240/6.46 |
| 2,783,364 | 2/1957 | Wood | 240/6.46 |

*Primary Examiner*—James L. Jones, Jr.
*Attorney, Agent, or Firm*—Jack D. Slobod

[57] ABSTRACT

An electric impact wrench for use in conjunction with an automobile has a rotary power tool in a housing, a cable emanating from the housing has alligator clips at its end for engaging the terminals of a car battery. The impact tool includes a light on the housing to facilitate night tire changing.

1 Claim, 3 Drawing Figures

AUTOMOTIVE ELECTRIC IMPACT WRENCH

FIELD OF THE INVENTION

The present invention relates generally to battery operated rotary power tools and in particular to a power tool for changing tires at night adapted to be powered by a car battery.

BACKGROUND OF THE INVENTION

There is a need to provide an impact wrench, adapted to be powered by a car battery, for doing various normal and emergency maintenance work on an automobile such as tire changing, where there is no available or convenient electrical wall outlet. While various rotary power tools are known in the prior art which operate on batteries, I am aware of no prior art rotary power tool configured to supply sufficient torque to serve as an impact wrench while operating from a car battery.

OBJECTS OF THE INVENTION

It is an object of the present invention to provide an electric impact wrench for working on an automobile which may draw power from the battery within the automobile.

It is a further object of the present invention to provide an electric impact wrench for working on an automobile which will allow work on said car to be done in darkness.

SUMMARY OF THE INVENTION

Briefly, the aforementioned and other objects of the present invention are satisfied by providing a rotary power tool, capable of driving a socket, which power tool includes a cable terminating in connectors for engaging the terminals of a car battery to receive power therefrom. To facilitate working on the car in darkness, the housing for the power tool carries a lamp which is also energized via the cable.

Other objects, features and advantages of the present invention will become apparent upon perusal of the following detailed description of the preferred embodiment thereof when taken in conjunction with the appended drawing wherein.

DETAILED DESCRIPTION

Figures 1, 2, 3:
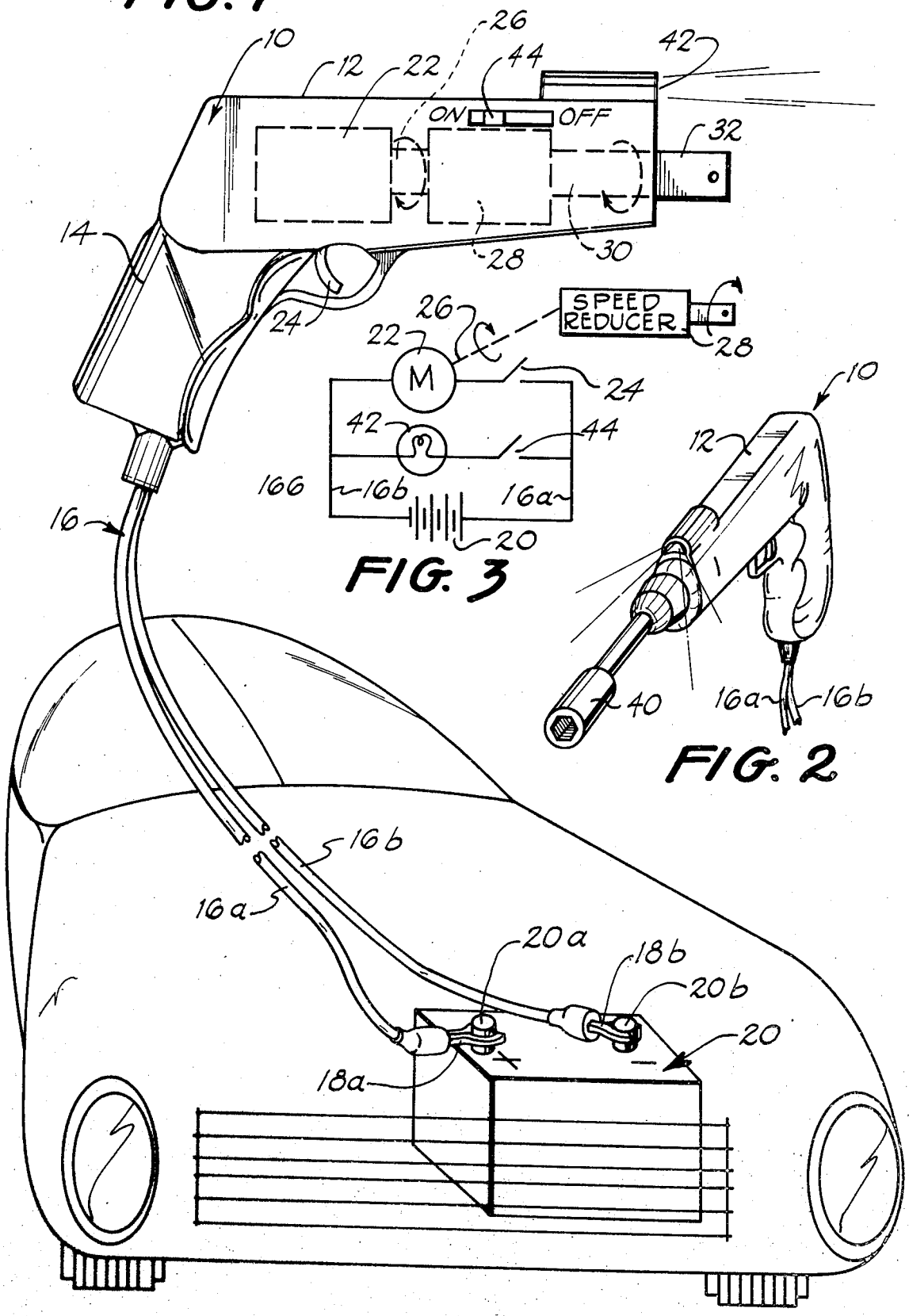
FIG. 1 is a pictorial presentation showing the use of the impact tool of the present invention in conjunction with an automobile. The tool is shown in side view.
FIG. 2 is a pictorial presentation of the tool in FIG. 1.
FIG. 3 is an electro-mechanical schematic diagram for the tool in FIGS. 1 and 2.

Referring to FIGS. 1 through 3, the electric impact tool 10 of the present invention comprises a rotary power tool within a gun-shaped housing 12 having a grip portion 14. Emanating from the end of the grip portion 14 of the housing is a cable 16 comprising a pair of insulated wires 16*a* and 16*b* which respectively terminate in alligator chips 18*a* and 18*b*, or other suitable connector, for respectively engaging the terminals 20*a* and 20*b* of auto battery 20. Within housing 12 is a D.C. motor 22, of preferably approximately one third horsepower which is configured to be energized by 12 volts D.C. Alternatively, for the few cars equipped with a 6 volt battery, motor 22 may be wound to be driven by 6 volts.

Motor 22 receives a driving electric current from the battery 20 via the wires 16*a* and 16*b*. The motor 22 is connected in series with a switch 24 positioned as a trigger on the gun shaped housing 12. The motor 22 and switch 24 combination are in turn connected in series with wires 16*a* and 16*b*. When the trigger switch 24 is depressed, motor 22 is energized by battery 20 and an output shaft 26 for the motor rotates.

For producing a torque high enough for tool 10 to be used as an impact wrench, the motor output shaft drives a speed reducer gear train 28, which may be of the planetary type and may be of an intermittent or ratcheting action. The output shaft 30 from speed reducer 28 terminates outside of housing 12 in a standard square drive 32, as of ⅜ inch, for drivingly carrying a standard socket tool 40 (FIG. 2).

I prefer, in order to make tool 10 simple and inexpensive to provide no electrical or mechanical reversing means in housing 12 for selecting either clockwise or counterclockwise rotation for drive 32. Instead, selection of rotation direction is done by which of the clips 18*a* and 18*b* is connected to which of terminals 20*a* and 20*b*. Thus, for example, clockwise rotation is accomplished by connecting clip 18*a* to positive battery terminal 20*a* and clip 18*b* to negative battery terminal 20*b*, while counterclockwise rotation of drive 32 is accomplished by connecting clip 18*a* to negative battery terminal 20*b* and clip 18*b* to positive battery terminal 20*a*.

In order to facilitate work on an auto in darkness, a lamp 42 is provided mounted on housing 12 and aimed in a direction parallel to drive 32. Lamp 42 is connected in series with an on-off switch 44 on housing 12. The combination of the lamp 42 and switch 44 is connected with housing 12 across the wires 16*a* and 16*b*. As should be apparent, the lamp 42 may be used independently of using motor 22, because separate switches 24 and 44 are provided for the motor and for the lamp.

Having described the preferred embodiment of my invention it should be apparent that various modifications are possible to that embodiment which are still within the spirit and scope of my invention. Therefore, reference as to the scope of my invention should be made to the following claims.

What is claimed is:

1. A power tool apparatus adapted to receive a socket tool for working on an automobile comprising, a housing for said power tool, a motor within said housing, means drivingly connected to said motor for carrying said socket tool, a light on said housing to facilitate night work on said automobile, two-conductor cable means emanating from said housing for supplying electrical power to said motor and said light, a free end of said cable means having electrical connector means configured to simultaneously engage the two terminals of an auto battery, first switch means on said housing electrically interposed between said cable means and said motor and second switch means on said housing electrically interposed between said cable means and said light.

* * * * *